US011373557B2

(12) United States Patent
Hatton

(10) Patent No.: US 11,373,557 B2
(45) Date of Patent: Jun. 28, 2022

(54) FRAME ASSEMBLY FOR DISPLAYING A TENSIONABLE TEXTILE MEDIA

(71) Applicant: BUDNICK CONVERTING, INC., Columbia, IL (US)

(72) Inventor: Richard J. Hatton, Wellington, OH (US)

(73) Assignee: BUDNICK CONVERTING, INC., Columbia, IL (US)

( * ) Notice: Subject to any disclaimer, the term of this patent is extended or adjusted under 35 U.S.C. 154(b) by 12 days.

(21) Appl. No.: 16/936,532

(22) Filed: Jul. 23, 2020

(65) Prior Publication Data

US 2021/0027664 A1 Jan. 28, 2021

Related U.S. Application Data

(60) Provisional application No. 62/877,360, filed on Jul. 23, 2019.

(51) Int. Cl.
*G09F 7/18* (2006.01)
*G09F 13/04* (2006.01)

(52) U.S. Cl.
CPC ..... *G09F 7/18* (2013.01); *G09F 13/0413* (2013.01); *G09F 2007/1843* (2013.01); *G09F 2007/1886* (2013.01)

(58) Field of Classification Search
CPC ..... G09F 7/18; G09F 13/0413; G09F 2007/1843; G09F 2007/1886; A47G 1/10; A47G 1/101
See application file for complete search history.

(56) References Cited

U.S. PATENT DOCUMENTS 2,083,354 A * 6/1937 Whittier ..... E06B 3/9845 403/382
3,552,050 A * 1/1971 Marateck ..... A47G 1/10 40/782
3,698,114 A * 10/1972 Hirsch ..... A47G 1/0605 40/782
4,090,799 A * 5/1978 Crotti ..... B29C 65/08 40/782
4,136,470 A * 1/1979 Barz ..... A47G 1/10 40/782
4,477,990 A * 10/1984 Buchanan ..... A47G 1/10 40/784
4,630,386 A * 12/1986 Wilson ..... A47G 1/0605 40/734
5,617,660 A * 4/1997 Pollack ..... G09F 15/0012 40/606.16
8,833,581 B2 * 9/2014 Kuo ..... B65D 85/48 220/4.28
2001/0034989 A1 * 11/2001 Geiberger ..... A47G 1/0611 52/287.1
2003/0145502 A1 * 8/2003 Roy ..... A47G 1/102 40/782
2010/0043268 A1 * 2/2010 Powell ..... A47G 1/10 40/741

(Continued)

*Primary Examiner* — David R Dunn
*Assistant Examiner* — Christopher E Veraa
(74) *Attorney, Agent, or Firm* — Renner, Otto, Boisselle & Sklar, LLP

(57) ABSTRACT

A slotted frame assembly for receiving tensionable textile media, e.g., a sign face, the textile media being tucked into frame slots in the assembly to provide attachment and tensioning.

18 Claims, 8 Drawing Sheets

(56) References Cited

U.S. PATENT DOCUMENTS

| | | | | |
|---|---|---|---|---|
| 2010/0202827 | A1* | 8/2010 | Frey | A47G 1/10<br>403/359.3 |
| 2016/0015191 | A1* | 1/2016 | Lawson | A47G 1/102<br>40/782 |
| 2016/0143462 | A1* | 5/2016 | Pirayesh | A47G 1/08<br>40/700 |
| 2019/0290028 | A1* | 9/2019 | Hatton | A47G 1/10 |
| 2020/0204769 | A1* | 6/2020 | Chen | A47G 1/102 |

* cited by examiner

FRAME ASSEMBLY FOR DISPLAYING A TENSIONABLE TEXTILE MEDIA

This application claims priority to U.S. Provisional Application No. 62/877,360 filed Jul. 23, 2019, which is incorporated herein by reference.

TECHNICAL FIELD

This invention relates to a frame assembly for displaying a tensionable textile media which may be in the form of a sign.

BACKGROUND

Silicone edge graphics (SEG) are a class of signage consisting of a frame assembly, typically made of aluminum, which contains slots for receiving a sign face which is printed on textile media. The textile media is attached to the frame by means of silicone edges formed at the margins of the textile media and tucked into the frame slots, providing both attachment and tensioning.

SUMMARY

This invention relates to a frame assembly for displaying a tensionable textile media. The textile media may comprise a sign. The frame assembly comprises four side rails connected to form a quadrilateral frame. Each side rail comprises one or more elongated frame sections. The elongated frame sections are made of a polymeric material and may be referred to as extruded side rails.

This invention relates to an elongated frame section comprising: a base wall and a vertical wall extending lengthwise in a longitudinal direction, the base wall comprising a first mortice channel extending through the base wall in the longitudinal direction; the vertical wall extending in a vertical direction from an end of the base wall at a right angle, the vertical wall having an upper end with an upper textile media mounting slot, an opposite lower end with a lower textile media mounting slot, the upper and lower textile media mounting slots extending through the vertical wall in the longitudinal direction, and a second mortice channel positioned between the upper textile media mounting slot and the lower textile media mounting slot and extending through the vertical wall in the longitudinal direction; wherein the elongated frame section comprises a unitary construction formed from a polymeric material. The elongated frame section may have a first and an opposite second end, the first and second ends being cut at acute angles relative to the upper and lower textile media mounting slots.

The elongated frame section may have a first and an opposite second end, the first and second ends being cut at obtuse angles relative to the upper and lower textile media mounting slots.

This invention relates to a process for making the elongated frame section, comprising extruding the polymeric material to form the elongated frame section.

This invention relates to a corner connector, comprising: a base portion having a first side, a second side aligned orthogonally with the first side, a third side aligned orthogonally with the second side, and a fourth side aligned orthogonally with the first side; a first vertical wall extending in a vertical direction from the first side of the base portion; a second vertical wall extending in a vertical direction from the second side of the base portion, the second vertical wall being aligned orthogonally with the first vertical wall to form a corner; the first vertical wall having an upper end with an upper textile media mounting slot and a lower end with a lower textile media mounting slot; the second vertical wall having an upper end with an upper textile media mounting slot and a lower end with a lower textile media mounting slot; a first protrusion extending laterally from the third side of the base portion; and a second protrusion extending laterally from the fourth side of the base portion; wherein the corner connector comprising a unitary construction formed from a polymeric material.

The corner connector may be made by a process comprising molding the polymeric material to form the corner connector.

This invention relates to a dual functional connector tenon comprising: a straight tenon having a base wall, a first end and a second end, the first end comprising a male fitting with one or more protrusions projecting from the base wall, the second end comprising a female fitting with one or more indentations in the base wall. The dual functional connector tenon may be sized to fit snugly in the first mortice channel of the elongated frame section.

The frame assembly may comprise a first elongated frame section aligned orthogonally with and connected to a second elongated frame section to form a corner of the quadrilateral frame using a pair of dual functional connector tenons aligned at a right angle relative to each other.

The frame assembly may comprise a first elongated frame section and a second elongated frame section joined together in a straight line using a dual functional connector tenor to form a side of the quadrilateral frame, the dual functional connector tenon being inserted in a first end of the first mortice channel of the first elongated frame section and a second end of the first mortice channel of the second elongated frame section.

The frame assembly may comprise a straight connector tenon inserted in a first end of the second mortice channel of the first elongated frame section and a second end of the second mortice channel of the second elongated frame section.

The frame assembly may comprise a first elongated frame section connected to a second elongated frame section to form a corner of the quadrilateral frame; the first elongated frame section having a first end with a first dual functional connector tenon inserted in the first mortice channel of the first elongated frame section, the first dual functional connector tenon comprising a base wall with a first end and a second end, the first end comprising a male fitting, the male fitting extending outwardly from the first end of the first elongated frame section, the male fitting comprising one or more protrusions projecting from the base wall of the first dual functional connector tenon; the second elongated frame section having a second end with a second dual functional connector tenon inserted in the first mortice channel of the second elongated frame section, the second dual functional connector tenon comprising a base wall with a second end, the second end comprising a female fitting extending outwardly from the second end of the second elongated frame section, the female fitting comprising one or more indentations in the base wall of the second dual functional tenon; the male fitting of the first dual functional connector tenon being coupled to the female fitting of the second dual functional connector tenon to form a right angle connection. A corner connecting tenon may be used to connect the second mortice channel of the first elongated frame section to the second mortice channel of the second elongated frame section.

This invention provides an improvement upon the existing state of the art in several ways. This includes using elongated frame sections made from a polymeric material, rather than aluminum, the specific form of which provides not only support for the textile media, but also several assembly options, each of which gives a different visual appearance, all from a single elongated frame section profile.

Additionally, the frame assembly may employ a molded corner connector, which simplifies the creation of custom size signs, and a dual function connector tenon, which is uniquely designed to reduce tooling and production costs, while doubling the utility of the connector.

Taken together, these innovations create a modular slotted frame assembly for use with an SEG sign system which is simpler to construct, lower in cost to produce and transport, and offers more aesthetic options than previous SEG sign frame products.

BRIEF DESCRIPTION OF THE DRAWINGS

In the annexed drawings, like parts and like features have like designations.

DETAILED DESCRIPTION

Figure 1A:
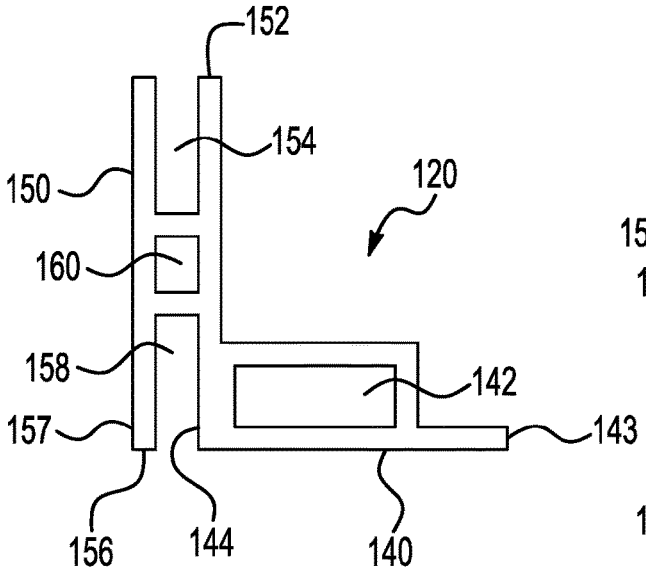
FIG. 1A is a cross-sectional view of an elongated frame section or side rail for use with the inventive slotted frame assembly, the elongate frame section comprising a base wall having a first mortice channel, and a vertical wall extending at a right angle from an end of the base wall and having upper and lower textile media mounting slots and a second mortice channel positioned between the upper and lower textile media mounting slots.

All ranges and ratio limits disclosed in the specification and claims may be combined in any manner. It is to be understood that unless specifically stated otherwise, references to "a," "an," and/or "the" may include one or more than one, and that reference to an item in the singular may also include the item in the plural.

The phrase "and/or" should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified unless clearly indicated to the contrary. Thus, as a non-limiting example, a reference to "X and/or Y," when used in conjunction with open-ended language such as "comprising" can refer, in one embodiment, to X without Y (optionally including elements other than Y); in another embodiment, to Y without X (optionally including elements other than X); in yet another embodiment, to both X and Y (optionally including other elements); etc.

The word "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," may refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of."

The phrase "at least one," in reference to a list of one or more elements, should be understood to mean at least one element selected from any one or more of the elements in the list of elements, but not necessarily including at least one of each and every element specifically listed within the list of elements and not excluding any combination of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of X and Y" (or, equivalently, "at least one of X or Y," or, equivalently "at least one of X and/or Y") can refer, in one embodiment, to at least one, optionally including more than one, X, with no Y present (and optionally including elements other than Y); in another embodiment, to at least one, optionally including more than one, Y, with no X present (and optionally including elements other than X); in yet another embodiment, to at least one, optionally including more than one, X, and at least one, optionally including more than one, Y (and optionally including other elements); etc.

The transitional words or phrases, such as "comprising," "including," "carrying," "having," "containing," "involving," "holding," and the like, are to be understood to be open-ended, i.e., to mean including but not limited to.

Referring to the drawings, frame assembly 100 is provided for displaying a tensionable textile media 110. The textile media may comprise a sign. The frame assembly 100 comprises four side rails 115 connected to form a quadrilateral frame 130. Each side rail 115 comprises one or more elongated frame sections 120. The elongated frame sections 120 are made of a polymeric material. The polymeric material may comprise an acrylonitrile butadiene styrene copolymer, polyvinyl chloride, polystyrene, or a mixture of two or more thereof.

Each elongated frame section 120 comprises a base wall 140 and a vertical wall 150 with each extending lengthwise in a longitudinal direction. The base wall 140 comprises a first mortice channel 142 extending through the base wall 140 in the longitudinal direction. The vertical wall 150 extends in a vertical direction from an end 144 of the base wall 140 at a right angle. The vertical wall 150 has an upper end 152 with an upper textile media mounting slot 154, an opposite lower end 156 with a lower textile media mounting slot 158. The upper and lower textile media mounting slots 154 and 158 extend through the vertical wall 150 in the longitudinal direction. The vertical wall includes second mortice channel 160 which is positioned between the upper textile media mounting slot 154 and the lower textile media mounting slot 158 and extends through the vertical wall 150 in the longitudinal direction. The elongated frame section 120 comprises a unitary construction formed from a polymeric material. The vertical wall 150 may have a height, as measured from lower end 156 to upper end 152, in the range from 25 to about 50 mm, or about 30 to about 45 mm, or about 35 to about 40 mm, or about 38 mm. The elongated frame section 120 may have width, as measured from end 143 to end 157, in the range from about 25 to about 50 mm, or from about 30 to about 45 mm, or about 38 mm. The mortice channel 142, which may be referred to as a large mortice channel, may have a cross-section with heights and widths ranging from about 3 to about 15 mm, or from about 5 to about 10 mm. The mortice channel 160, which may be referred to as a small mortice channel, may have a cross-section with heights and widths ranging from about 3 to about 6 mm, or from about 4 to about 6 mm. The upper textile medium slot 154 and the lower textile medium slot 158 may each have a width in the range from about 3 to about 6 mm, or from about 4 to about 6 mm, and a depth in the range from about 10 to about 15 mm, or from about 12 to about 15 mm. The length of the elongated frame section 120 may be of any desired value, for example, from about 20 to about 300 cm, or from about 20 to about 120 cm.

Referring to FIGS. 6A-6E and 16A, the elongated frame section 120 may have a first end 122 and an opposite second end 124, the first and second ends being cut at acute angles 121 relative to the upper and lower textile media mounting slots 154 and 158.

Referring to FIGS. 8A-8C and 16B, the elongated frame section 120 may have a first end 122 and an opposite second end 124, the first and second ends being cut at obtuse angles 123 relative to the upper and lower textile media mounting slots 154 and 158.

The process for making the elongated frame section 120, may comprise extruding a polymeric material to form the elongated frame section. The polymeric material may comprise an acrylonitrile butadiene styrene (ABS) copolymer, polyvinyl chloride, polystyrene, or a mixture of two or more thereof.

Referring to FIGS. 13A-13C and 14A-14B, corner connector 170 may comprise a base portion 172 having a first side 174, a second side 176 aligned orthogonally with the first side 174, a third side 178 aligned orthogonally with the second side 176, and a fourth side 180 aligned orthogonally with the first side 174. A first vertical wall 182 extends in a vertical direction from the first side 174 of the base portion 172. A second vertical wall 184 extends in a vertical direction from the second side 176 of the base portion 172.

The second vertical wall 184 is aligned orthogonally with the first vertical wall 182 to form a corner 186. The first vertical wall 182 has an upper end 190 with an upper textile media mounting slot 192 and a lower end 194 with a lower textile media mounting slot 196. The second vertical wall 184 has an upper end 220 with an upper textile media mounting slot 202 and a lower end 204 with a lower textile media mounting slot 206. A first protrusion 208 extends laterally from the third side 178 of the base portion 172. A second protrusion 210 extends laterally from the fourth side 180 of the base portion 172. The corner connector 170 comprises a unitary construction formed from a polymeric material. The vertical walls 182 and 184 may have heights in the range from 25 to about 50 mm, or about 30 to about 45 mm, or about 35 to about 40 mm, or about 38 mm. The upper textile media mounting slots 192 and 202 and the lower textile medium mounting slots 196 and 206 may each have a width in the range from about 3 to about 6 mm, or from about 4 to about 6 mm, and a depth in the range from about 10 to about 15 mm, or from about 12 to about 15 mm.

The corner connector 170 may be made by a process comprising molding the polymeric material to form the corner connector. The polymeric material may comprise an acrylonitrile butadiene styrene (ABS) copolymer, polyvinyl chloride, polystyrene, or a mixture of two or more thereof.

Referring to FIGS. 4A-4E, dual functional connector tenon 220 comprises a straight tenon having a base wall 222, a first end 224 and a second end 226. The first end 224 comprises a male fitting 228 with one or more protrusions 229 projecting from the base wall 222. The second end 226 comprises a female fitting 230 with one or more indentations 231 in the base wall 222. The dual functional connector tenon 220 may have a length in the range from about 5 to about 10 cm, or from about 5 to about 8 cm. The tenon 220 may have beveled edges and may be sized to fit snugly in the first mortice channel 142 of the elongated frame section 120.

Figure 5:
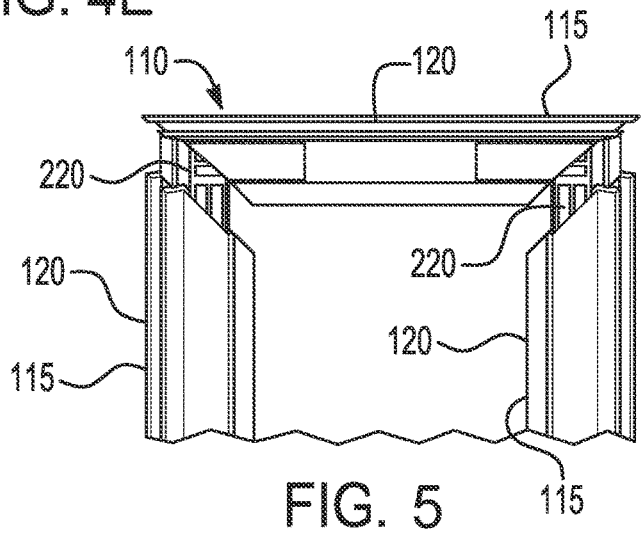
FIG. 5 is a partial schematic illustration of a slotted frame assembly with elongated frame sections aligned at right angles relative to each other and connected using dual functional connector tenons that are coupled together.

Referring to FIG. 5, the frame assembly 100 may comprise a first elongated frame section 120 aligned orthogonally with and connected to a second elongated frame section 120 to form a corner 250 of the quadrilateral frame 130 using a pair of dual functional connector tenons 220 aligned at a right angle relative to each other.

Referring to FIGS. 7A-7D, each side rail 115 of the frame assembly 100 may comprise a first elongated frame section 120 and a second elongated frame section 120 joined together in a straight line using a dual functional connector tenon 220. The dual functional connector tenon 220 may be inserted in a first end 240 of the first mortice channel 142 of the first elongated frame section 120 and a second end 242 of the first mortice channel 142 of the second elongated frame section 120. The frame assembly may further comprise a straight connector tenon 270 inserted in a first end 240 of the second mortice channel 160 of the first elongated frame section 120 and a second end 242 of the second mortice channel 160 of the second elongated frame section 120.

Referring to FIGS. 6A-6E and 8A-8C, the frame assembly 100 may comprise a first elongated frame section 120 connected to a second elongated frame section 120 to form a corner 250 of the quadrilateral frame 130. The first elongated frame section 120 has a first end 122 with a first dual functional connector tenon 220 inserted in the first mortice channel 142 of the first elongated frame section 120. The second elongated frame section 120 has a second end 124 with a second dual functional connector tenon 220 inserted in the first mortice channel 142 of the second elongated frame section 120. A corner connecting tenon 272 is used to connect the second mortice channel 160 of the first elongated frame section 120 to the second mortice channel 160 of the second elongated frame section.

Figure 14A:
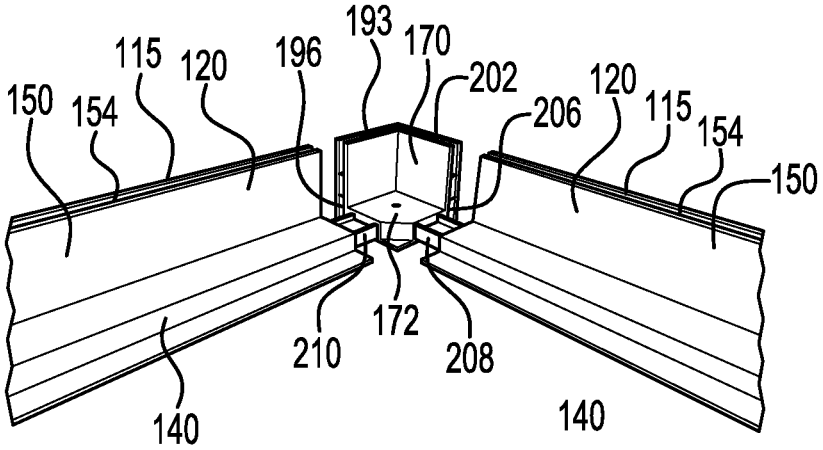
FIGS. 14A and 14B are schematic illustrations of a corner of the inventive slotted frame assembly using the corner connector shown in FIGS. 13A-13C and two of the elongated frame sections shown in FIGS. 6A-6E.
Figure 14B:
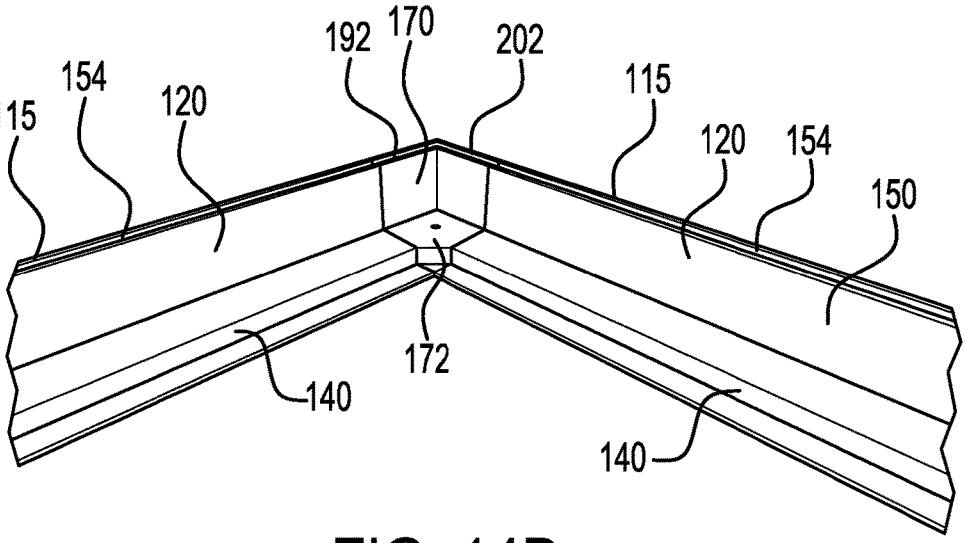

The corner connector 170 may be used to connect elongated frame sections 120 cut perpendicular to the length of the elongated frame section 120. This is shown in FIGS. 13A-13C and 14A-14C. Molded corner connectors 170 may be used to form a corner (FIGS. 14A-14B). The elongated frame sections 120 may be cut perpendicular to the length of the elongated frame sections 120, which is an easier cut to make than an angle cut. Because the material of construction is a polymer and the cut is a right angle, unlike the typical aluminum extrusion, the elongated frame sections 120 can be cut easily and accurately with common saws such as a hand miter saw, or a power chop saw. This makes the frame assembly 100 easy and quick to customize to any desired dimension.

Figure 6A:
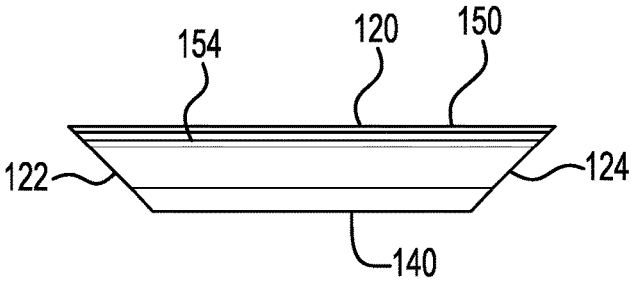
FIG. 6A is a top plan view of an elongated frame section with the ends cut at a 45° C. angle. The ends are cut at an acute angle relative to the textile media mounting slots.
Figure 8A:
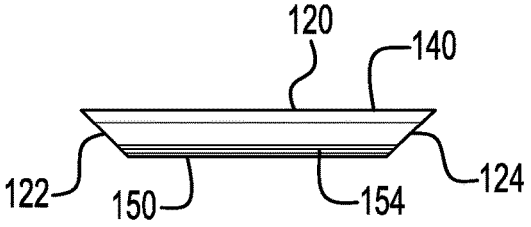
FIG. 8A is a top plan view of an elongated frame section with the ends cut at an angle of 45°. The ends are cut at an obtuse angle relative to the textile media mounting slots.
Figure 8B:
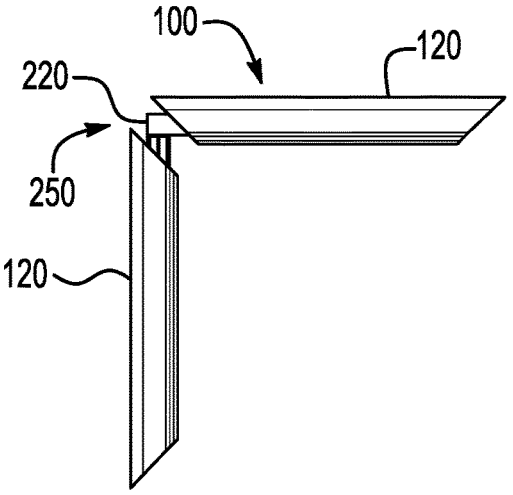
FIG. 8B is a schematic illustration of two elongated frame sections as illustrated in FIG. 8A connected together using a pair of dual functional connector tenons coupled together to form a right angle connection, the tenons being inserted in the first mortice channel of each of the elongated frame sections.
Figure 8C:
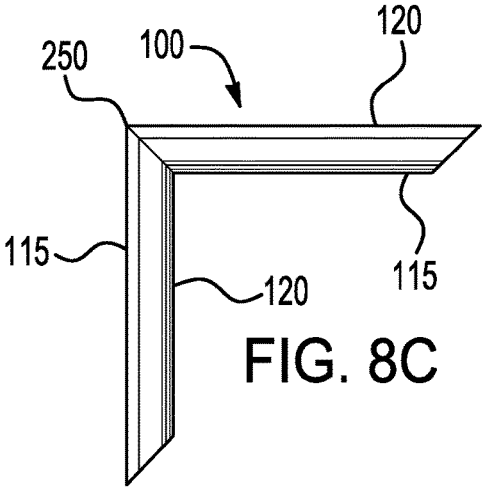
FIG. 8C is a schematic illustration of a corner of the inventive slotted frame assembly formed from two elongated frame sections as illustrated in FIG. 8A.

Another option for creating corners is to cut the elongated frame section 120 at a 45-degree angle as shown in FIGS. 6A and 8A.

Figure 7A:
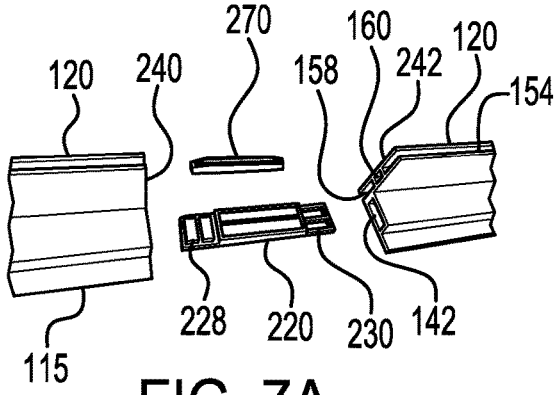
FIGS. 7A-7D are schematic illustration showing two elongated frame sections connected in a straight line using a straight line connecting tenon (FIG. 2) and a dual functional connecting tenon (FIGS. 4A-4C and 4E).
Figure 7B:
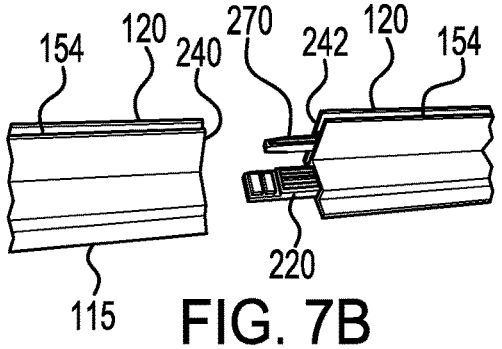
Figure 7C:
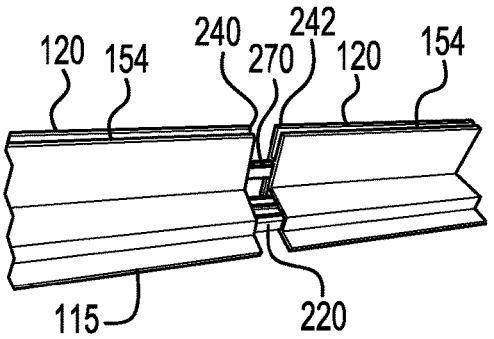
Figure 7D:
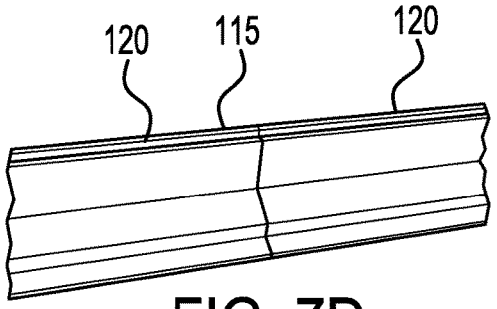

Irrespective of which corner connecting method is used, the frame assembly 100 may require a way to be connected to create extended length sides (FIG. 7D). The dual functional connector tenon 220 may be used to accomplish both corner and straight connecting functions with a single part.

Figure 4A:
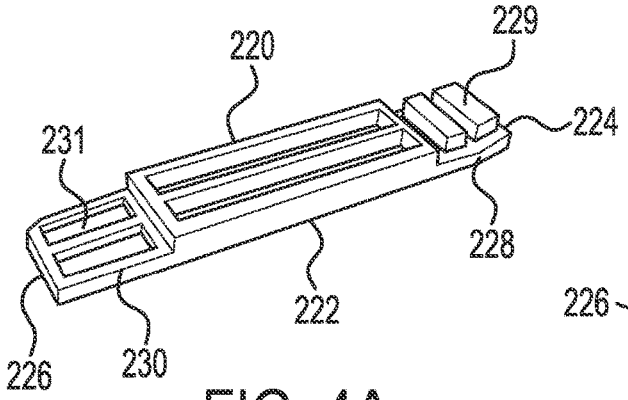
FIG. 4A is a schematic illustration of a dual functional connector tenon for connecting elongated frame sections to form the inventive slotted frame assembly.
Figure 4B:
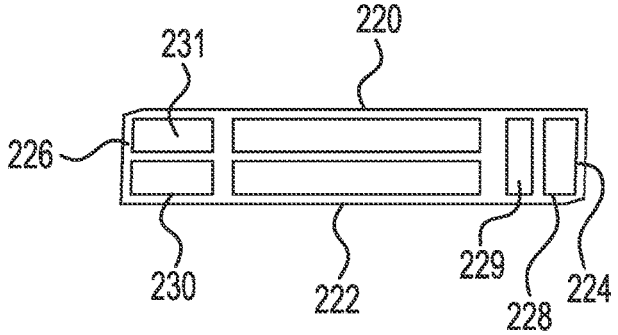
FIG. 4B is a top plan view of dual functional connector tenon shown in FIG. 4A.
Figure 4C:
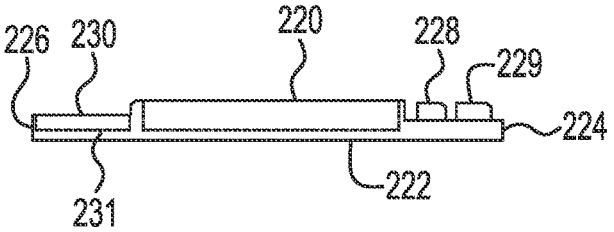
FIGS. 4C and 4E are side elevational views of the dual functional connector tenon shown in FIG. 4A.
Figure 4D:
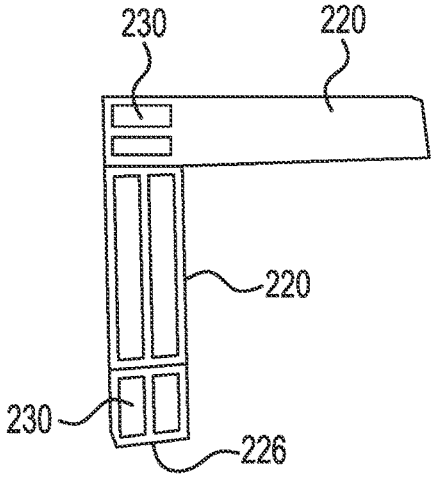
FIG. 4D is a top plan view of two dual functional connector tenons coupled together for connecting elongated frame sections to form a corner section the inventive slotted frame assembly.
Figure 4E:
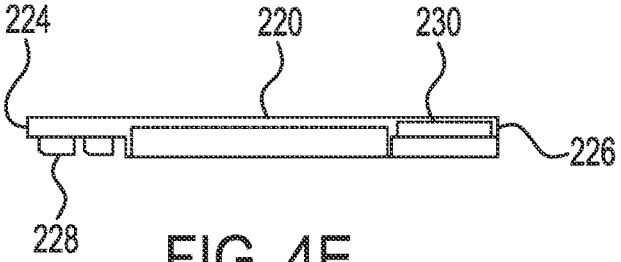

Referring to FIGS. 4A-4E, the dual functional connector tenon 220 may comprise a molded polymer straight tenon sized to fit snugly when inserted in the first mortice channel 142 of the elongated frame sections 120. A unique feature of the dual functional connector tenon 220 is found in the complimentary design of each of the ends 224 and 226. At one end 224, there are protruding male structures 229. At the other end 226 there are recessive female structures 231. When two of these tenons are aligned such that the respective male 228 and female 230 ends are near to one another at a right angle, the two dual functional connector tenons 220 may be snapped together to form a precise 90-degree angle connector tenon as shown in FIG. 4D.

As a result of this design, one dual functional connector tenon 220 may perform two functions. A single tenon 220 may be used to join two lengths of the elongated frame sections 120 in a straight line to extend the frame length (FIG. 7A-7D). Alternatively, two tenons 220 may be used together to join elongated frame sections 120 at a 90-degree angle (FIG. 8B-8C for obtuse angle cut and FIG. 6A-6E for acute angle cut). This reduces the tooling (for instance injection molding dies) and the piece cost significantly since the piece production run volumes essentially double.

Another benefit of the male/female design of the dual functional connector tenon 220 is that the ends 224 and 226 of the tenon 220 are inherently narrower than the first mortice channel 142 and may have beveled edges, so the tenon 220 can be easily inserted into the first mortice channel 142.

Figure 2:
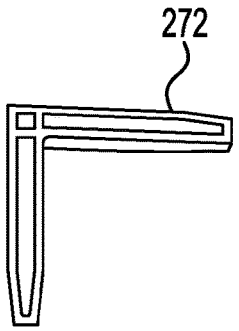
FIG. 2 is a side elevational view of a corner connecting tenon for connecting elongated frame sections to form the inventive slotted frame assembly.
Figure 3A:
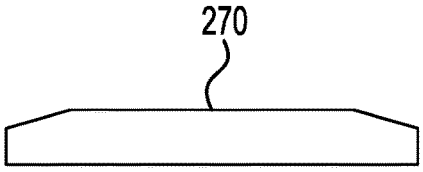
FIG. 3A is a top plan view of a straight connecting tenon for connecting elongated frame sections to form the inventive slotted frame assembly.
Figure 3B:
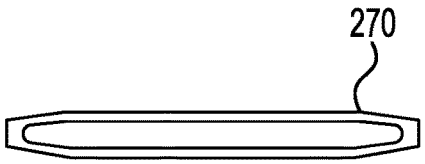
FIG. 3B is a side elevational view of the tenon shown in FIG. 3A.
Figure 6B:
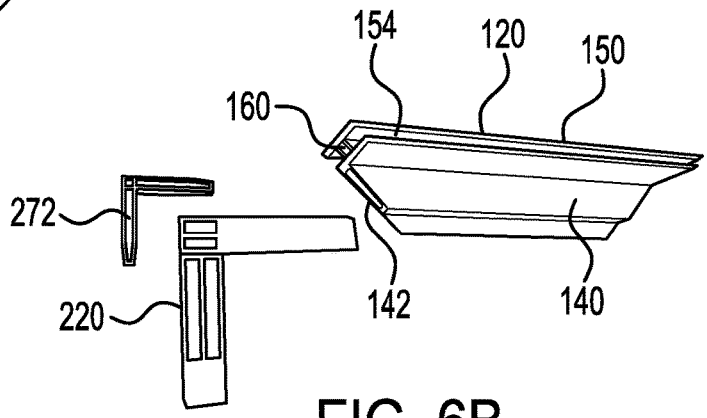
FIGS. 6B-6D are schematic illustrations of the elongated frame section of FIG. 6A with a corner connecting tenon insertable (FIG. 6B) or inserted (FIGS. 6C and 6D) in the second mortice channel of the elongated frame section, and a pair of dual functional connector tenons coupled together to form a right angle connection insertable (FIG. 6B) or inserted (FIGS. 6C and 6D) in the first mortice channel of the elongated frame section.
Figure 6C:
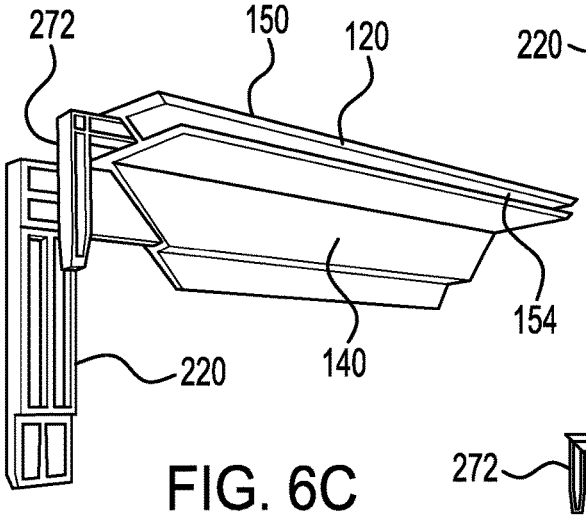
Figure 6D:
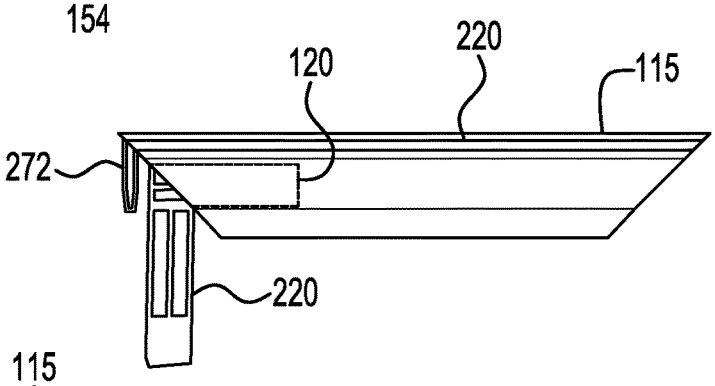
Figure 6E:
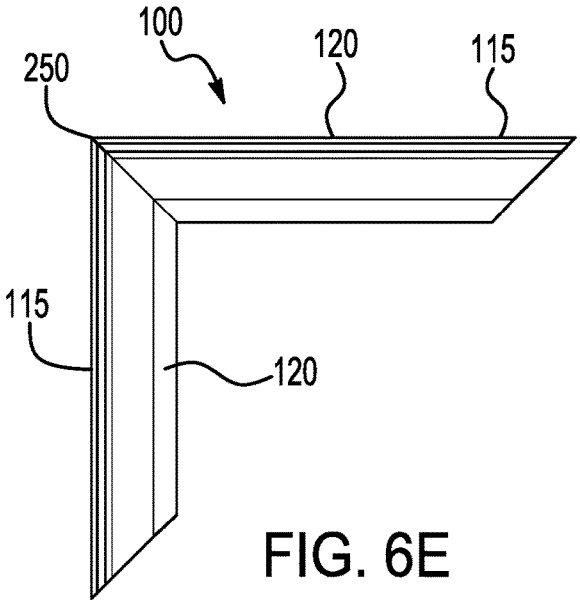
FIG. 6E is a schematic illustration of a corner of the inventive slotted frame assembly formed from two elongated frame sections as illustrated in FIG. 6A which are connected using the corner connecting tenon and dual functional connecting tenons shown in FIGS. 6B-6D.

The system also makes use of two additional tenons, a small channel straight connector tenon 270 (FIGS. 3A-3B), and a small channel corner connector tenon 272 (FIG. 2). These tenons may be used to connect the second mortice channel 160 for straight side extensions (FIGS. 7A-7C) and at corners (FIGS. 6B-6D).

Each of the components of the frame assembly 100 may be composed of extruded and molded parts, typically made of copolymers of acrylonitrile butadiene styrene (ABS), polystyrene, polyvinyl chloride, or another suitable polymer. Benefits over aluminum include lower cost, lighter weight, resistant to surface damage, easier to cut, safer to handle (less sharp when cut), and easy to paint without surface preparation.

Figure 1B:
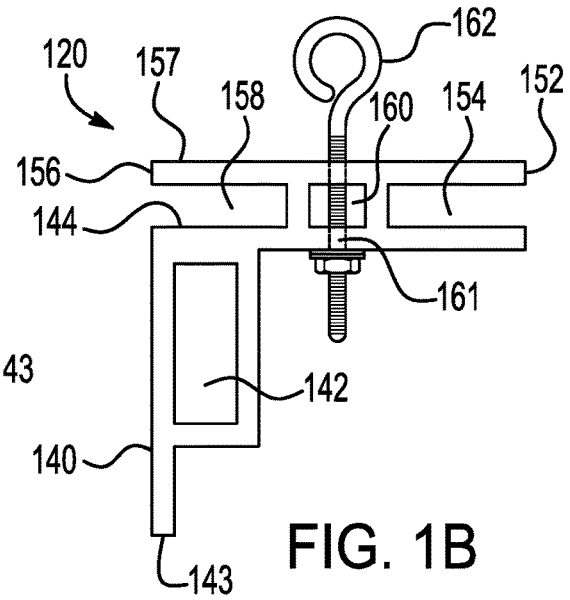
FIG. 1B is a cross-sectional view similar to the view shown in FIG. 1A with the exception that a hook for suspending the slotted frame assembly is inserted in the vertical wall.
Figure 1C:
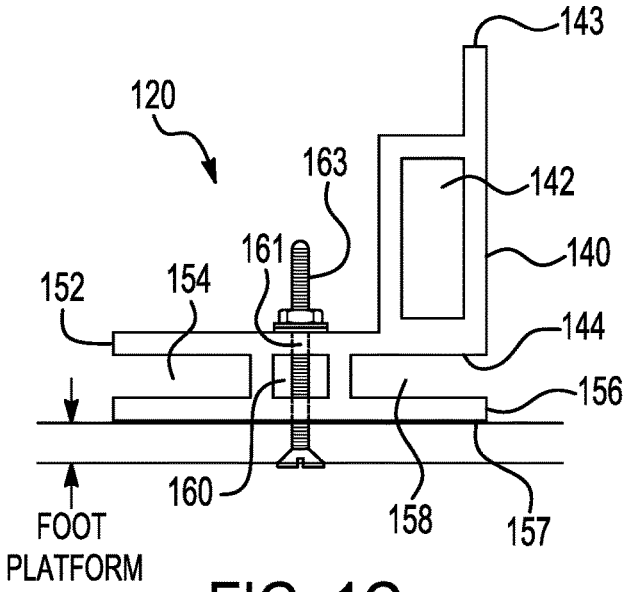
FIG. 1C is a cross-sectional view similar to the view shown in FIG. 1A with the exception that a bolt for mounting the slotted frame assembly is inserted in the vertical wall.

The specific shape of the profile of the elongated frame section 120 is essential to its utility. See, FIG. 1A. The profile has a vertical wall 150 and a base or horizontal wall 140, which are at a 90-degree angle with respect to one another. The vertical wall 150 incorporates textile media mounting slots 154 and 158 on both the top and the bottom, which enable the assembled frame 100 to hold textile graphic prints on two sides. The two textile media mounting slots are separated by center mortice channel 160, which may be referred to as a "small mortice channel". The channel 160 has several functions. First it can receive a small channel corner connecting tenon 272 (FIG. 2) for corner connections, or a small channel strait connecting tenon 270 (FIG. 3A-3B) for extended elongated frame section connections. Secondly, it provides a gap between the two textile media mounting slots 154 and 158, through which a hole 161 may be drilled by the assembler, to install either eye bolts 162, to facilitate ceiling hanging of the assembled frame (FIG. 1B), or normal bolts 163 to fasten foot platforms (FIG. 1C) to allow free standing floor placement of the assembled frame. The outer and inner surfaces of the vertical wall 150 may be attractive finished surfaces.

The base wall 140 of the elongated frame section 120 incorporates the bottom textile media mounting slot 158 and a flat base. Above the base wall 140 and adjacent to the vertical wall 150 is mortice channel 142 which may be referred to as a "large mortice channel". The large mortice channel 142 has several functions. First, it may receive large dual functional connecting tenons 220 (FIG. 4A-4E) for connecting the frame at corners (FIG. 5), as well as for extending the length of the frame sides by connecting straight frame elongated frame sections 120 pieces (FIGS. 7A-7D). Secondly, the rectangular cross section of the large mortice channel 142 adds structural strength and rigidity to the elongated frame section 120. Finally, it creates an attractive molding appearance when assembled in one of three possible configurations. Both the top and bottom surface of the base wall 140 may be attractive finished surfaces. The shape and finish of the elongated frame section 120 are essential to its utility because it incorporates the strength reinforcing feature of the mortice channels 142, while the resulting surfaces and shapes are visually appealing when assembled in several configurations. One elongated frame section 120 may thus be used to produce three different sign display shape based on how they are assembled.

Figure 9A:
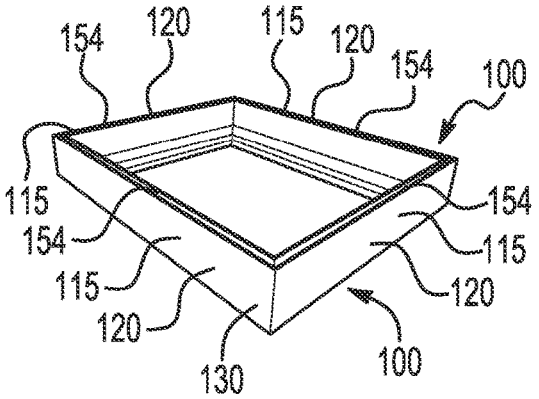
FIG. 9A is a schematic illustration of the inventive slotted frame assembly comprising four elongated frame sections connected to form a quadrilateral frame with an upper textile print mounting slot shown at the top of each elongated frame section.
Figure 9B:
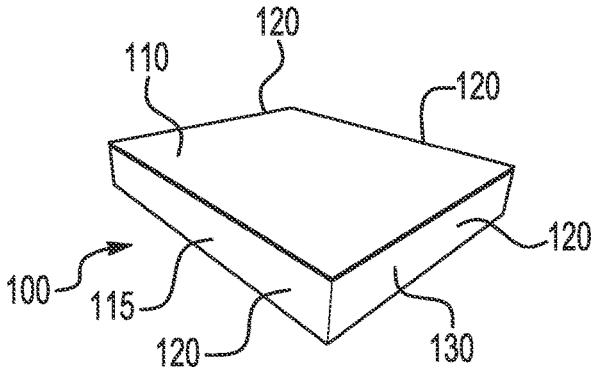
FIG. 9B is a schematic illustration of the slotted frame assembly shown in FIG. 9A with a tensionable textile media with a sign face installed in the upper textile media mounting slot of each of the elongated frame sections.

If the elongated frame sections 120 are cut at a 45-degree angle, the corners can be joined with special connecting tenons described above, the dual function al connector tenon 220 (FIGS. 4A-4E) and the small channel corner connector tenon 272 (FIG. 2). Because of the design of the elongated frame sections 120, the elongated frame sections 120 may be cut with either an acute angle with respect to the textile media mounting slots 154 and 158 (see, FIG. 6A), or an obtuse angle (see, FIG. 8A). Cutting with an acute angle results in elongated frame sections 120 which, when assembled into a frame, result in a standard configuration (FIG. 9A), where the support element of the frame (the large mortice channel 142) is hidden on the inside of the sign after a textile sign face or faces are installed (FIG. 9B).

Figure 10:
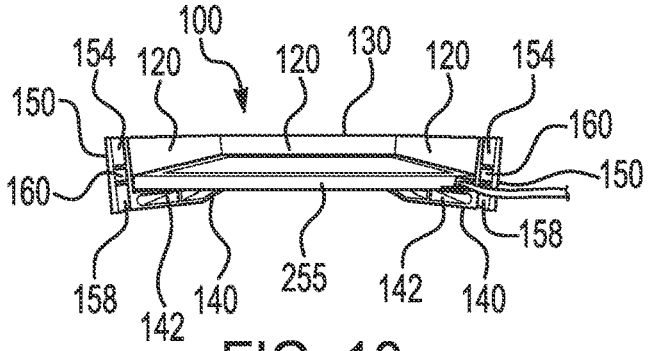
FIG. 10 is a schematic illustration of the slotted frame assembly shown in FIGS. 9A and 9B with a LED light panel inserted in the assembly and supported by the first mortice channel in the elongated frame sections used to form the assembly.

In this standard assembly, the large mortice channel 142 forms a platform which may be used to support an LED light panel 255, if backlighting of the graphic is desired (FIG. 10)

Figure 11A:
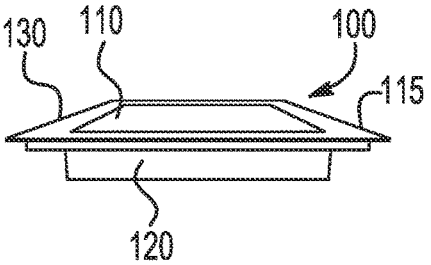
FIGS. 11A and 11B are schematic illustrations of the inventive slotted frame assembly wherein a tensionable textile sign face is installed in the lower textile media mounting slots of each of the elongated frame sections, the assembled sign having the appearance of a protruding graphic with a multi-level base molding.
Figure 11B:
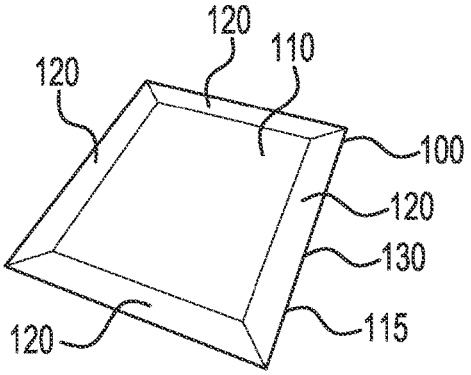
Figure 12A:
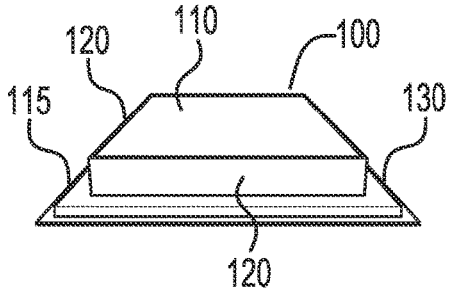
FIGS. 12A and 12B are schematic illustrations of the assembled sign shown in FIGS. 11A and 11B turned upside down.
Figure 12B:
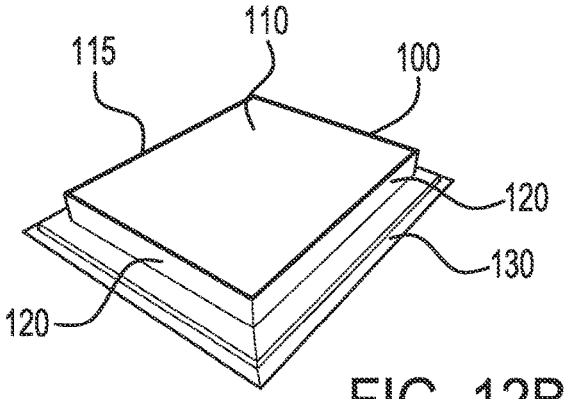
Figure 13A:
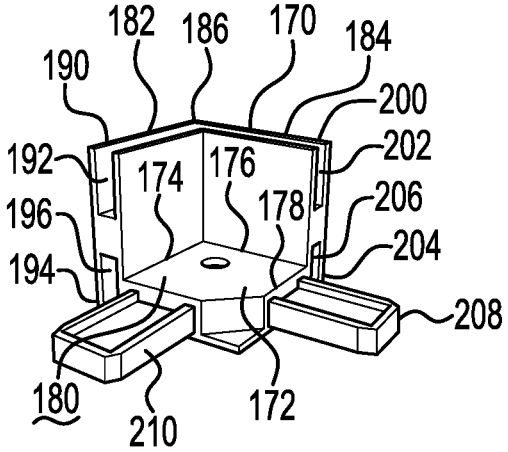
FIGS. 13A-13C are schematic illustrations of a corner connector used to connect two of the elongated frame sections to form a corner of the inventive slotted frame assembly.
Figure 13B:
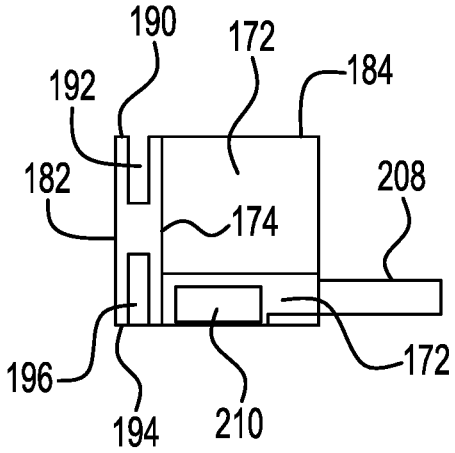
Figure 13C:
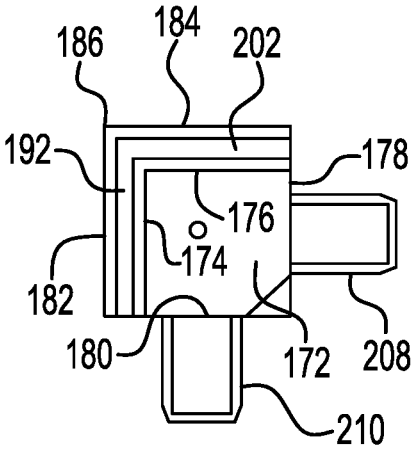

If the elongated frame sections 120 are cut with an obtuse angle (FIG. 8A-8D) with respect to the textile media mounting slots 154 and 158, two additional assembled configurations become possible. When the printed textile sign face is mounted on the lower textile media mounting slots 158 which are incorporated into the base wall 140, the base wall 140 creates a wide framed visual effect (FIGS. 11A-11B). Alternatively, if the printed textile sign face is installed in the upper textile media mounting slots 154 opposite those which are incorporated into the base wall 140, the assembled sign has the appearance of a protruding graphic, with a multi-level base molding (FIGS. 12A-12B).

In this way the shape of the profile of the elongated frame section 120, and based on its materials, and finishes, is unique from all previous SEG sign frames. One single elongated frame section 120, when combined with the above described molded corners 170, or dual function connector tenon 220 (FIG. 4A-4D), may yield three aesthetically unique presentations (FIG. 9B, FIG. 11B, FIG. 12B). The combination of the corner attachment options with the straight edge attachment options, namely the dual functional connector tenon 220 and the small channel straight connector tenon 270, allow the assembler to create SEG sign frames of any size or dimension, with a few basic parts.

Figure 15A:
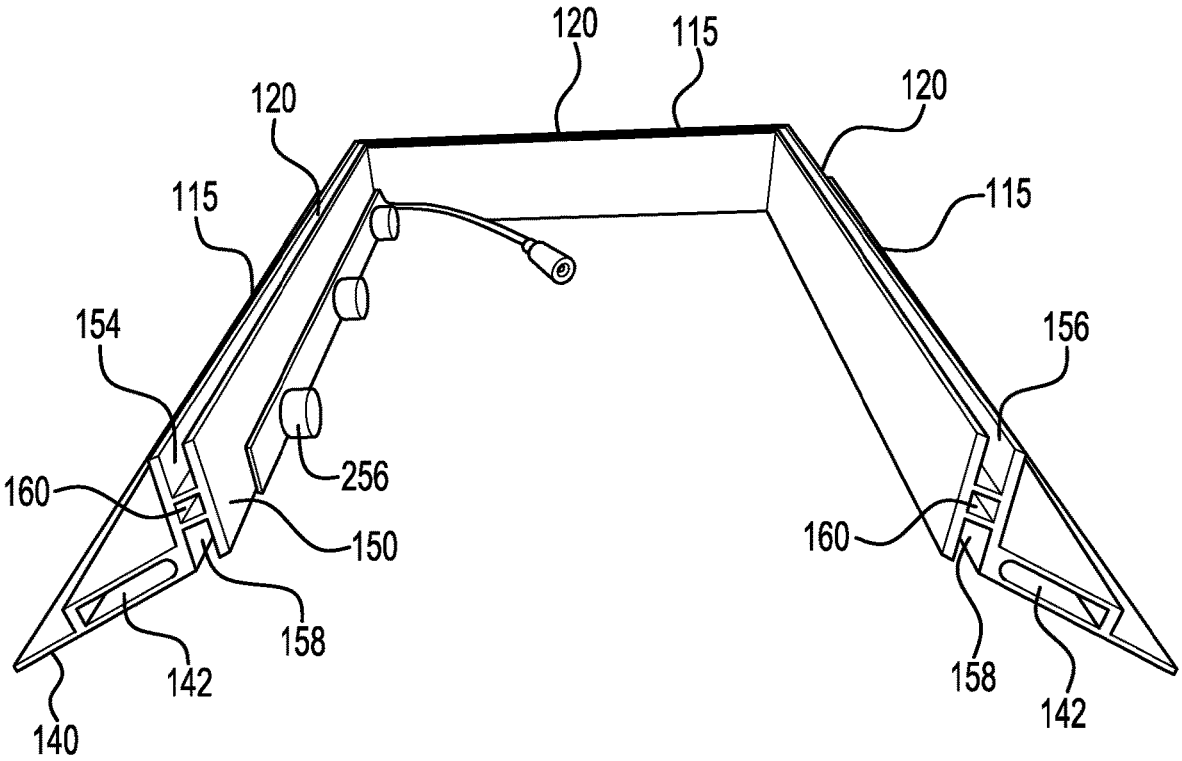
FIGS. 15A and 15B are schematic illustrations of the inventive slotted frame assembly with a strip module LED light mounted in the interior of the frame assembly.
Figure 15B:
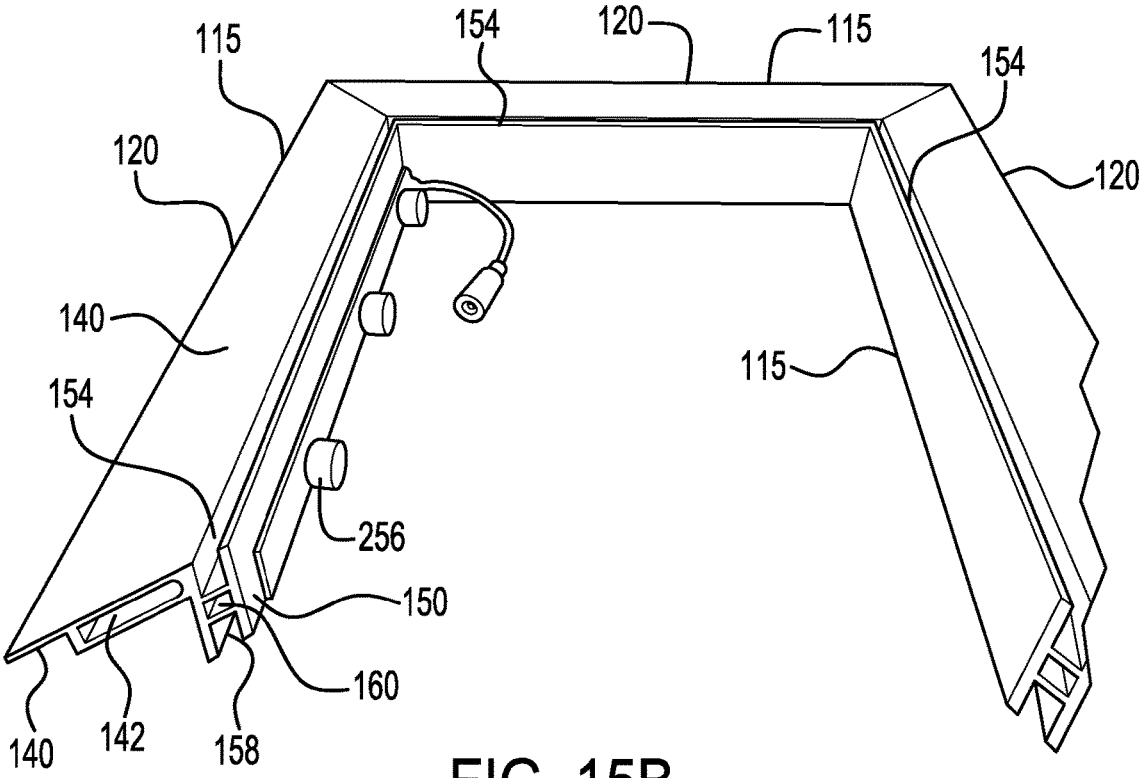
Figure 16A:
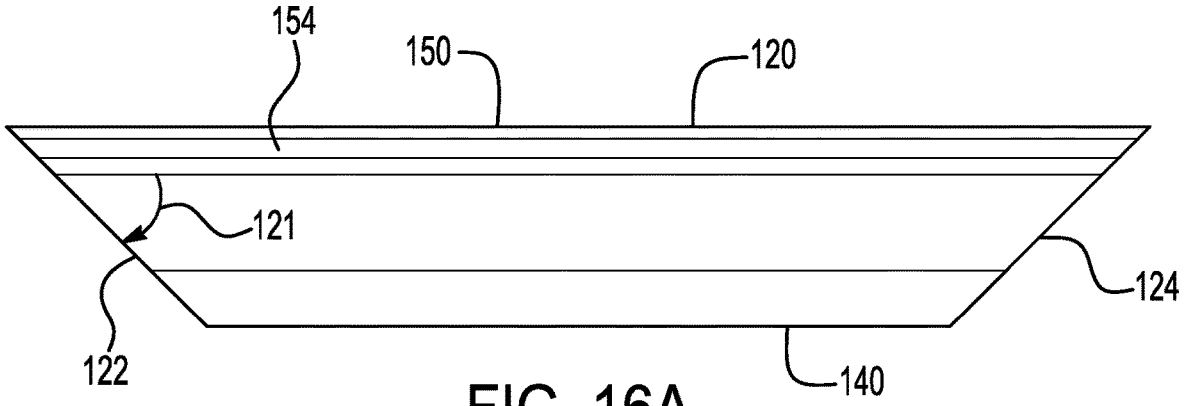
FIG. 16A is a top plan view of an elongated frame section with the ends cut at a 45° C. angle. The ends are cut at an acute angle relative to the textile media mounting slots.
Figure 16B:
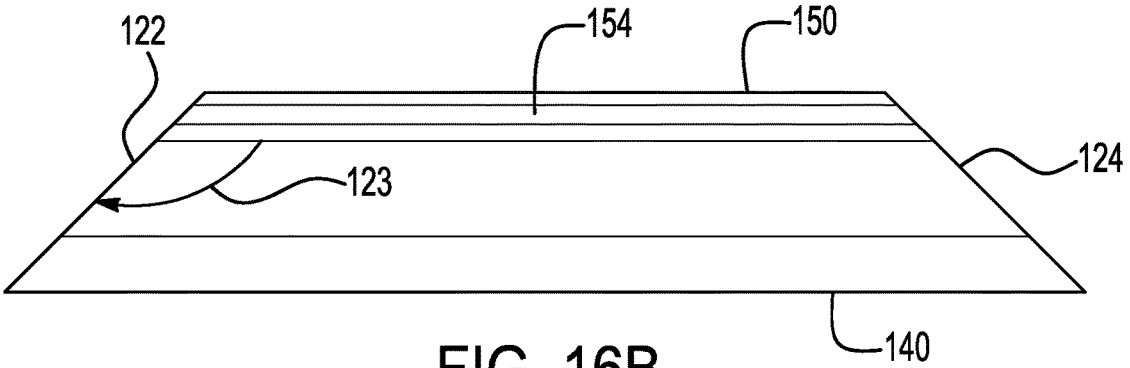
FIG. 16B is a top plan view of an elongated frame section with the ends cut at an angle of 45°. The ends are cut at an obtuse angle relative to the textile media mounting slots.

When the elongated frame section 120 profile is cut at an obtuse angle with respect to the textile media mounting slots 154 and 158, and assembled using the dual function connector tenons 220 as well as the small channel corner connecting tenons 272 to create the corners, the large mortice channel 142 and the rest of the base wall 140 can be positioned on the exterior of the textile media mounting slot. This opens up the area on the interior of the sign frame to strip module LED lights 256 (FIG. 15A-15B). Strip module LED lights are less expensive to produce and ship and offer greater size flexibility compared with panel LED lights 255, which are typically produced in exactly fixed sizes to fit a specific frame size (for example FIG. 10). By contrast strip module LEDs can be added modularly as a sign increases in size to produce a very cost-effective edge lit SEG sign. Thus, the frame system described herein allows for great flexibility in the creation of backlit SEG signs. While the invention has been explained in relation to various embodiments, it is to be understood that various modifications thereof will become apparent to those skilled in the art upon reading the specification. Therefore, it is to be understood that the invention disclosed herein includes any such modifications that may fall within the scope of the appended claims.

The invention claimed is:

1. A frame assembly for displaying a tensionable textile media, comprising:

four side rails connected to form a quadrilateral frame, each side rail comprising an elongated frame section comprising:

a base wall and a vertical wall extending lengthwise in a longitudinal direction, the base wall comprising a first mortice channel extending through the base wall in the longitudinal direction;

the vertical wall extending in a vertical direction from an end of the base wall at a right angle, the vertical wall having an upper end with an upper textile media mounting slot, an opposite lower end with a lower textile media mounting slot, the upper and lower textile media mounting slots extending through the vertical wall in the longitudinal direction, and a second mortice channel positioned between the upper textile media mounting slot and the lower textile media mounting slot and extending through the vertical wall in the longitudinal direction;

wherein the elongated frame section comprises a unitary construction formed from a polymeric material;

wherein:

a first elongated frame section is connected to a second elongated frame section to form a corner of the quadrilateral frame;

the first elongated frame section having a first end with a first dual functional connector tenon inserted in the first mortice channel of the first elongated frame section, the first dual functional connector tenon comprising a base wall with a first end and a second end, the first end comprising a male fitting, the male fitting extending outwardly from the first end of the first elongated frame section, the male fitting comprising one or more protrusions projecting from the base wall of the first dual functional connector tenon:

the second elongated frame section having a second end with a second dual functional connector tenon inserted in the first mortice channel of the second elongated frame section, the second dual functional connector tenon comprising a base wall with a second end, the second end comprising a female fitting extending outwardly from the second end of the second elongated frame section, the female fitting comprising one or more indentations in the base wall of the second dual functional connector tenon; and the male fitting of the first dual functional connector tenon being coupled to the female fitting of the second dual functional connector tenon to form a right angle connection.

2. The frame assembly of claim 1 wherein the polymeric material comprises an acrylonitrile butadiene styrene copolymer, polyvinyl chloride, polystyrene, or a mixture of two or more thereof.

3. The frame assembly of claim 1, wherein the elongated frame section has a height of about 25 to about 50 mm.

4. The frame assembly of claim 1, wherein the elongated frame section has a first and an opposite second end, the first and second ends being cut at acute angles relative to the upper and lower textile media mounting slots.

5. The frame assembly of claim 1, wherein the elongated frame section has a first and an opposite second end, the first and second ends being cut at obtuse angles relative to the upper and lower textile media mounting slots.

6. The frame assembly of claim 1, wherein the second mortice channel has parallel sidewalls and a hole is provided in the sidewalls to permit insertion of a bolt or a hook in the hole.

7. A process for making the frame assembly of claim 1, comprising extruding the polymeric material to form the elongated frame section.

8. The frame assembly of claim 1, wherein a corner connecting tenon connects the second mortice channel of the first elongated frame section to the second mortice channel of the second elongated frame section.

9. A corner connector, comprising:

a base portion having a first side, a second side aligned orthogonally with the first side, a third side aligned orthogonally with the second side, and a fourth side aligned orthogonally with the first side;

a first vertical wall extending in a vertical direction from the first side of the base portion;

a second vertical wall extending in a vertical direction from the second side of the base portion, the second vertical wall being aligned orthogonally with the first vertical wall to form a corner;

the first vertical wall having an upper end with an upper textile media mounting slot and a lower end with a lower textile media mounting slot;

the second vertical wall having an upper end with an upper textile media mounting slot and a lower end with a lower textile media mounting slot;

a first protrusion extending laterally from the third side of the base portion; and a second protrusion extending laterally from the fourth side of the base portion;

wherein the corner connector comprising a unitary construction formed from a polymeric material.

10. The corner connector of claim 9, wherein the polymeric material comprises an acrylonitrile butadiene styrene copolymer, polyvinyl chloride, polystyrene, or a mixture of two or more thereof.

11. The corner connector of claim 9, wherein the first vertical wall and the second vertical wall have heights of about 25 to about 50 mm.

12. The corner connector of claim 9, wherein a hole is provided in the base portion to permit insertion of a bolt in the hole.

13. A process for making the corner connector of claim 9, comprising molding the polymeric material to form the corner connector.

14. A frame assembly for displaying a tensionable textile media, comprising:

four side rails connected to form a quadrilateral frame, each side rail comprising an elongated frame section, and the corner connector according to claim 8 connecting two of the four side rails together.

15. The frame assembly of claim 14, wherein a first elongated frame section is aligned orthogonally with and connected to a second elongated frame section to form a corner of the quadrilateral frame using a pair of dual functional connector tenons of the corner connector aligned at a right angle relative to each other.

16. The frame assembly of claim 14, wherein a first elongated frame section and a second elongated frame section are joined together in a straight line using a dual functional connector tenor to form a side of the quadrilateral frame, the dual functional connector tenon being inserted in a first end of the first mortice channel of the first elongated frame section and a second end of the first mortice channel of the second elongated frame section.

17. The frame assembly of claim 16, wherein a straight connection channel tenon is inserted in a first end of the second mortice channel of the first elongated frame section and a second end of the second mortice channel of the second elongated frame section.

18. A frame assembly for displaying a tensionable textile media, comprising:

four side rails connected to form a quadrilateral frame, each side rail comprising an elongated frame section comprising:

a base wall and a vertical wall extending lengthwise in a longitudinal direction, the base wall comprising a first mortice channel extending through the base wall in the longitudinal direction;

the vertical wall extending in a vertical direction from an end of the base wall at a right angle, the vertical wall having an upper end with an upper textile media mounting slot, an opposite lower end with a lower textile media mounting slot, the upper and lower textile media mounting slots extending through the vertical wall in the longitudinal direction, and a second mortice channel positioned between the upper textile media mounting slot and the lower textile media mounting slot and extending through the vertical wall in the longitudinal direction;

wherein the elongated frame section comprises a unitary construction formed from a polymeric material;

wherein a first elongated frame section is aligned orthogonally with and connected to a second elongated frame section to form a corner of the quadrilateral frame using a pair of dual functional connector tenons aligned at a right angle relative to each other; and wherein the dual functional tenon comprises a straight tenon sized to fit snugly in the first mortice channel of one of the elongated frame sections, the straight tenon having a base wall with a first end and a second end, the first end comprising a male fitting with one or more protrusions projecting from the base wall of the tenon, the second end comprising a female fitting with one or more indentations in the base wall of the tenon.

* * * * *